United States Patent [19]

Vana

[11] 4,320,631

[45] Mar. 23, 1982

[54] AIR DEFROST FOR LOW-BED REFRIGERATED DISPLAY CASES, UTILIZING SILL-MOUNTED AUXILIARY FAN

[75] Inventor: John H. Vana, Allentown, N.J.

[73] Assignee: Emhart Industries, Inc., Farmington, Conn.

[21] Appl. No.: 227,846

[22] Filed: Jan. 23, 1981

[51] Int. Cl.[3] ..... A47F 3/04; F25D 21/10

[52] U.S. Cl. ..... 62/256; 62/282

[58] Field of Search ..... 62/82, 282, 256

[56] References Cited

U.S. PATENT DOCUMENTS

| | | | |
|---|---|---|---|
| 3,082,612 | 3/1963 | Beckwith | 62/256 |
| 3,226,945 | 1/1966 | Spencer | 62/256 |
| 3,333,437 | 8/1967 | Brennan | 62/256 |
| 3,403,525 | 10/1968 | Beckwith et al. | 62/256 |
| 3,850,003 | 11/1974 | Beckwith et al. | 62/256 |
| 4,120,174 | 10/1978 | Johnston | 62/256 |
| 4,182,130 | 1/1980 | Ljung | 62/256 |
| 4,265,092 | 5/1981 | Abraham | 62/256 |
| 4,285,204 | 8/1981 | Vana | 62/282 X |

*Primary Examiner*—Lloyd L. King

*Attorney, Agent, or Firm*—Frederick A. Zoda; John J. Kane; Albert Sperry

[57] ABSTRACT

A commercial refrigerated display case, of the type in which an air curtain is directed across an upwardly opening product display space, utilizes ambient air for defrost purposes. A discharge sill extending along the back of the case, above the discharge grille through which air is directed to form the air curtain, is hollowly formed to provide a defrost air chamber. Within the chamber defrost air fans are mounted and are normally off during the refrigeration cycle of the display case. During defrost, the air circulating fan continues in operation although the evaporator coil is no longer in a refrigeration mode. At the same time the defrost fan goes into operation, and draws off part of the air circulated through the discharge grille by the main fan, and exhausts it to ambient through the discharge sill. A weak air curtain is still maintained across the access opening of the display case. Drawing off part of the air through the discharge grille, while continuing operation of the main fan, causes at least a substantial part of the air drawn through the return opening to be obtained from the surrounding ambient, so as to swiftly defrost the evaporator.

12 Claims, 3 Drawing Figures

AIR DEFROST FOR LOW-BED REFRIGERATED DISPLAY CASES, UTILIZING SILL-MOUNTED AUXILIARY FAN

BACKGROUND OF THE INVENTION

1. Field of the Invention

The invention relates generally to the field of commercial refrigeration, and in a more particular sense, has reference to defrosting of an upwardly opening, low-bed, refrigerated food display case by the use of ambient air.

It may be appropriately considered, accordingly, that the field of the invention has to do with display cases in which the food product is accessible through a continuously open access space, over which an air curtain is maintained at least during the refrigeration mode. It may be further considered that the field of the invention relates to defrosting of such cases, by use of a fluid (air) drawn from outside the refrigerating system itself, that is, the ambient atmosphere surrounding the case.

2. Description of the Prior Art

Defrosting of refrigerated display cases of the type described above has been accomplished, usually, by "hot gas" (or sometimes "cool gas") directed through the tubing of an evaporator; or by electrical heating elements. Most recently, the defrosting of the evaporators by means of air drawn from the surrounding ambient has also received attention as a commercially practicable method of defrosting cases of this type. It has been contended, on behalf of air defrost, that a hot gas defrost system complicates and increases the amount of piping to an undesirable extent; and that electrical defrost consumes too much energy.

These contentions may or may not be valid. However, it is obviously desirable in any event to offer additional defrost methods if at all possible, to suit the needs or desires of particular customers. Accordingly, within the last twenty years, considerable effort has been exerted in the industry to develop workable air defrost systems.

Probably the earliest U.S patent relating to air defrost of a refrigerted display case of the air curtain type is Beckwith U.S. Pat. No. 3,082,612 issued in 1963. This related to a case having multiple air curtains. Most of the patents issued since that data, covering air defrost for display cases of the air curtain type, have similarly related to cases having multiple air curtains, typically found in open front, upright cases.

Low-bed, upwardly opening cases of the air curtain type are usually single curtain cases. There are problems in developing air defrost for this type of case, that are peculiar thereto, and various approaches have been made to effect a workable air defrost for these low-bed, single curtain display cases.

An early disclosure of air defrost for low-bed, single curtain cases, possibly the earliest, is the U.S. patent to Spencer, U.S. Pat. No. 3,226,945. In this patent, the suggestion is for use of pivoted dampers or baffles to change the air pattern. A German publication Offenlegungsschrift No. 2123646 employs ambient air in reverse flow defrost to lower the required electrical input to a defrost heater element.

U.S. Pat. No. 4,120,174 issued to Johnston in 1978 is also of the type in which the air flow is reversed to change the air pattern. In this patent, air defrost is accomplished by the mentioned reversal of the direction of air movement, together with the use of a specially designed bi-oriented air return grille, and/or a means for increasing or allowing unrestrained air flow during defrost as compared to that occurring during normal refrigeration.

The most recent U.S. patent covering air defrost in low-bed cases is believed to be Ljung U.S. Pat. No. 4,182,130. In this patent, which relates specifically to so-called island cases having back-to-back display wells, a mechanical means is utilized to physically relocate the air return, to change the air pattern during defrost as compared to refrigeration.

All of these developments, while very possibly being entirely feasible from a commercial standpoint, are thought to have specific deficiencies or inadequacies that should, if possible, be eliminated. For example, it is desirable to avoid pivoted dampers as much as possible, since they tend to malfunction over a period of time and are difficult to maintain at full efficiency. Simple reversal of air flow may also be undesirable in this particular kind of case, for the reason that it may completely destroy an air curtain during defrost. In some cases, it may be desirable to maintain a weak air curtain, to protect the displayed products, during the defrost mode, especially in view of the fact that it is not practical to provide refrigeration for the products in a single curtain case, during the defrost mode. Indeed, in some instances it may be impossible to do so.

It is also desirable to achieve a case design in which a carefully conceived pre-selection can be made of the air volume removed from the air curtain and exhausted to atmosphere so as to in turn pre-select both the volumetric content, if any, of the air curtain during defrost, and the resultant volume of air drawn into the air passage from the surrounding ambient through the air return. It is obviously desirable to impart these characteristics to the equipment without incorporating therein pivoted dampers, venturis, or the like, and it is also desirable to design the case in such a manner as to incorporate adjustability into the defrost air system, again without the use of pivoted dampers or other mechanical expedients.

Finally, it may be observed that air-defrosting of low-bed cases through simple reversal of the circulating fans, has been found to be satisfactory in meat cases, but results in over-long and hence unacceptable defrost cycles when incorporated in low-bed freezers. The present invention is particularly designed, accordingly, for efficient defrosting of low-bed freezer cases, but may be usable to equal advantage in defrosting meat cases should the use of reversible fans be considered undesirable in that application.

SUMMARY OF THE INVENTION

Summarized briefly, the invention comprises a low-bed, upwardly opening, single-curtain, refrigerated display case in which a conventional air discharge grill and air return are utilized, the case also being characterized by the absence of dampers or other means inserted in the air passage. A case of this type includes a rear sill overlying the air discharge grille, and in accordance with the invention it is proposed to form the rear sill hollowly, incorporating therein a defrost air chamber, the bottom wall of which is formed with a series of inlet ports downstream from the discharge grille. A series of auxiliary fans, operable only during defrost, is provided within the defrost air chamber of the rear or discharge sill, which when operated will draw air in through the inlet ports, and will discharge it into the surrounding ambient.

During normal refrigeration, the defrost fans are off. Refrigeration is accordingly achieved in a wholly conventional manner, using a completely conventional discharge grill and air return, and an air passage extending about the product well in a wholly conventional manner.

During defrost, the air circulating fan conventionally provided in the air passage continues to operate in the normal manner and in the normal direction. The defrost fans also operate, however, and as a result, draw at least part of the circulated air passing through the discharge grille, exhausting the air so removed, into the surrounding ambient. As a result, the air curtain is reduced to a selected extent or indeed, may be eliminated entirely in some instances. Since the air circulating fan is still operating in a normal fashion, air is drawn from the surrounding ambient into the return, to replace that which has been exhausted through the defrost air chamber, thus to effect defrosting of the evaporator coil as well as the walls or other critical areas of the air passage.

BRIEF DESCRIPTION OF THE DRAWING

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
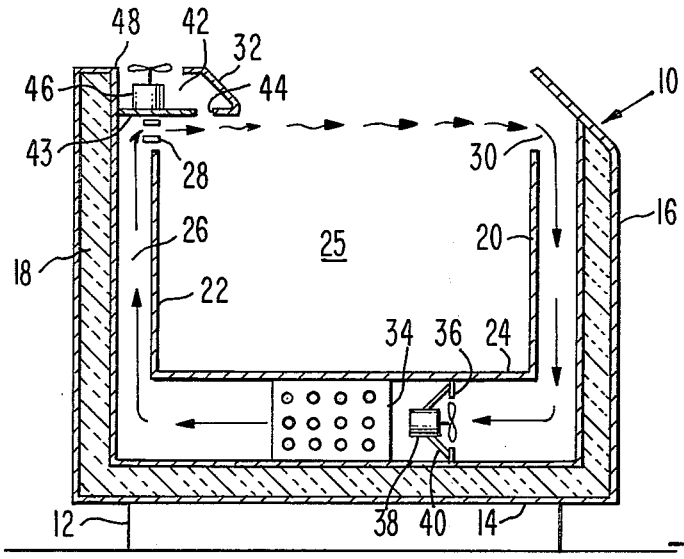
FIG. 1 is a cross-sectional view, partly schematic, through a display case constructed according to the present invention, as it appears in the refrigeration mode.

The reference numeral 10 generally designates a refrigerated display case of the low-bed or so-called "coffin" type, mounted upon a base 12 and including insulated bottom, front, and rear walls 14, 16, 18 respectively. The case also includes front, rear, and bottom duct panels 20, 22, 24, also as conventionally provided in cases of this type, cooperating to define a product well 25 continuously open at its top to provide access to the displayed food products.

The duct panels are spaced inwardly from their adjacent front, bottom, and rear walls, to define an air passage or duct 26 extending about the product well. Air flows through the air passage in the direction shown by the arrows in FIGS. 1 and 2, and is discharged from the air passage through an air discharge grille 28. During refrigeration (see FIG. 1) the air so discharged travels across the access opening of the product well, to an air return 30, so that the air is continuously recycled in a closed path, during refrigeration, as shown in FIG. 1.

In accordance with the invention, there is provided a discharge sill 32 mounted upon the upper end of the rear wall 18. Discharge sill 32 extends the length of the case, and overlies and extends forwardly from the air discharge grille 28.

Within the air passage 26 there is provided an evaporator 34. In the illustrated embodiment of the invention, a fan panel 36 is disposed upstream from the evaporator. A conventional air circulating fan 38 is mounted upon the fan panel through the medium of a conventional spider bracket 40.

Figure 2:
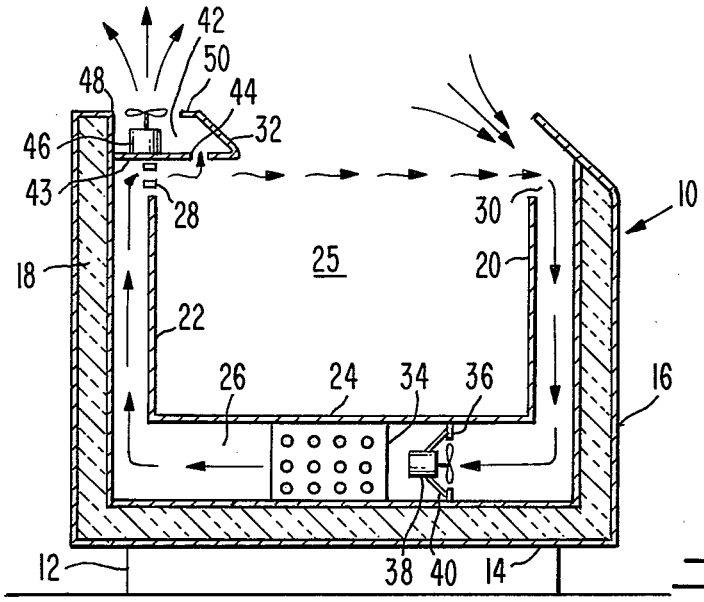
FIG. 2 is a similar view in which the case is illustrated during the defrost mode.

In accordance with the invention, the discharge sill is hollowly formed, to provide a defrost air chamber 42. A bottom plate 43 of the discharge sill extends directly above the discharge grille 28, and projects forwardly from the discharge grille as shown in FIGS. 1 and 2. The forwardly projecting portion of the base or bottom plate 43 is formed with a longitudinal series of closely spaced inlet ports 44 (see FIG. 3), disposed close to but downstream from the air discharge sill 28.

The forwardly projecting portion of base plate 43 of the discharge sill cooperates with the louvers or the conventional air discharge grille in shaping the air curtain formed by the air passing through the discharge grille. The inlet ports 44, in this connection, are so located as to communicate the air curtain with the defrost air chamber 42, immediately forwardly of the discharge grille 28, that is to say, downstream from the discharge grille.

Within the discharge sill there is provided a series of spaced defrost air or auxiliary fans 46, adapted when operating to exhaust air from the chamber 42 through outlet ports 48 provided in the top wall 50 of the discharge grille. The outlet ports may be screened, louvered, or otherwise designed to prevent articles from being dropped into the blades of the fans 46, or to prevent injury to customers.

Operation

In use of the refrigerated display case constituting the present invention, and assuming that the case is in a refrigerating mode, air will be directed through the air passage 26 in the manner shown in FIG. 1. At this time, only the fan or fans 38 will be in operation. The defrost fan or fans 46 will be idle.

As a result, the refrigeration cycle occurs in a wholly conventional manner, that is, a strong current of air passes into the inlet 30, being drawn directly across the case from the discharge grille 28. The air is thus circulated through the air passage and across the case in a closed cycle as shown by the direction arrows in FIG. 1, to properly chill the product and to offer protection against the intrusion of ambient into the well 25 through the upwardly opening access space.

At such time as the defrost cycle is to occur, the circulating fans 38 continue in operation. Refrigeration of the evaporator coil 34 is discontinued at this time, to be resumed at the termination of the defrost cycle.

Figure 3:
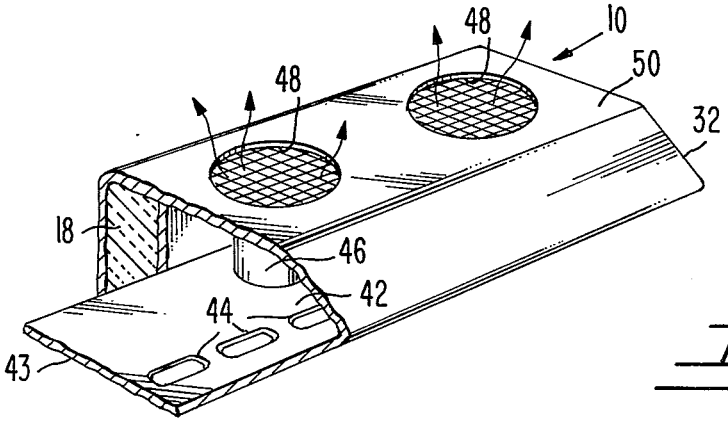
FIG. 3 is an enlarged, fragmentary perspective view of the discharge sill.

At this time the defrost fans 46 go into operation. As a result, the greatest part of the air discharged through the grille 28 is now sucked upwardly through inlet ports 44 into the defrost air chamber 42, and is exhausted to the surrounding ambient through the outlet ports 48 as shown in FIGS. 2 and 3.

It is considered desirable, in most instances, to maintain a reduced air curtain across the access space, as shown by the short, wavy arrows in FIG. 2. This is accomplished by pre-selecting the volumetric content of the air drawn through the inlet ports 44 by fans 46, in relation to the amount of air directed through the discharge grille 28 by operation of the circulating fans 38. By maintaining operation of the fans 38 in the normal fashion, and by having the fans 46 draw slightly less air through the ports 44 than is being forced out of the discharge grille 28, an air curtain will be maintained across the product well 25. This air curtain will be weakened, and will comprise the difference between the air drawn upwardly through the port 44 and that discharged through grille 28.

Since fan 38 is still in normal operation, however, the amount of air continuing within the air curtain will be insufficient to meet the requirements of the fans 38. Accordingly, an amount of air will be drawn from the surrounding ambient into the air inlet 30, corresponding to that which has been drawn through the port 44 and exhausted to ambient through outlet ports 48 of the discharge sill.

The ratio which the ambient air entering the air return 30 bears to the curtain air entering the grille can be accurately determined by pre-selection of the air circulating fans 38 and the defrost fans 46, that is, the number of the fans used, the horsepower thereof, fan blade pitch, and other characteristics known to those skilled in the art, can be selected in such a manner as to produce an exact ratio, volumetrically, of ambient air to curtain air entering the return. In other words, it is possible, in advance, to determine by fan selection the amount of air exhausted from the air curtain through inlet ports 44 during the defrost cycle. This determination in turn produces a desired ratio of ambient to curtain air entering the return. The design further permits adjustments to be made following actual installation. Simple adjustments in fan blade pitch, either in the circulating or the defrost fans, can be made to change the ratio. Other adjustments can be made, including the use of multi-speed fans 38, 46. Since an elongated display case will normally have an entire series of circulating fans 38, and another series of defrost fans 46, it is additionally possible to wire the fans electrically so that all or a selected fraction of the fans of each series can be operated, at a given time.

It is thus seen that the design permits a wide range of adjustment, with respect to the length of time that the defrost cycle will take, and that it is also possible to determine the relative strength of the air curtain during defrost, or for that matter, whether an air curtain is to be present at all. All of these factors are of importance, during manufacture of a case to meet the specific needs of a particular installation, and they are equally important in that they permit a wide range of adjustment to be made after installation during regular use of the equipment, all with a minimum of the operational problems that have been known to exist when dampers, restrictors, and other air flow control expedients have been employed.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a low-bed refrigerated display case having rear, bottom, and front walls providing a product well at the top of which an access opening is defined, the walls further providing an air passage that extends about the product well and a discharge grill and a return opening extending along the rear and front edges, respectively, of the access opening, an evaporator coil in the passage, and a circulating fan also mounted in the passage to circulate air through the passage and coil and form an air curtain in movement across access opening from the discharge grill to the return opening during the refrigeration mode of the case, the improvement comprising a discharge sill mounted on the rear wall above the outlet, the sill having a defrost air chamber to which entry is had through inlet ports located adjacent the discharge grille, and from which air may be discharged through outlet ports to the ambient atmosphere surrounding the case; and defrost air fan means mounted in the chamber and adapted for operation during a defrost mode in a direction to draw air into the chamber through the inlet ports and discharge it through the outlet ports, in a quantity such that at least part of the air exiting the discharge grille is discharged through the sill to the surrounding ambient and thereby diminishes the air curtain voluntarily to an extent effective to induce at least some ambient air to enter the return opening.

2. In a low-bed refrigerated display case, the improvement of claim 1 wherein the discharge sill has a base plate overlying the discharge grille, the inlet ports being formed in the base plate.

3. In a low-bed refrigerated display case, the improvement of claim 2 wherein the inlet ports are formed in the base plate at a location downstream from the discharge grille in the sense of the direction in which the air is moved during operation of the circulating fan.

4. In a low-bed refrigerated display case, the improvement of claim 3 wherein the discharge sill is hollowly formed to define said defrost air chamber.

5. In a low-bed refrigerated display case, the improvement of claim 3 wherein the inlet ports are arranged in closely spaced relation in a series extending longitudinally of the discharge sill.

6. In a low-bed refrigerated display case, the improvement of claim 2 wherein the discharge sill further includes a top wall in which the outlet ports are formed.

7. In a low-bed refrigerated display case, the improvement of claim 6 wherein the outlet ports are arranged in a series extending longitudinally of the sill.

8. In a low-bed refrigerated display case, the improvement of claim 7 wherein a defrost fan is located in the sill at the location of each outlet port.

9. In a low-bed refrigerated display case having rear, bottom, and front walls providing a product well at the top of which an access opening is defined, the walls further providing an air passage that extends about the product well and a discharge grill and return opening extending along the rear and front edges, respectively, of the access opening, an evaporator coil in the passage, and a circulating fan also mounted in the passage to circulate air through the passage and coil and form an air curtain in movement across access opening from the discharge to the return grille during the refrigeration mode of the case, defrost means including a second air-circulating fan operable from time to time for discharging into the surrounding ambient at least part of the air exiting the discharge grille, to diminish the air curtain volumetrically to an extent sufficiently that at least some of the air entering the return opening is drawn from the surrounding ambient.

10. In a low-bed refrigerated display case, the improvement of claim 9 wherein said means discharges into the ambient a fractional part of the air volume exiting through the discharge grille, whereby to maintain an air curtain between the discharge grill and inlet opening during operation of said second fan.

11. In a low-bed refrigerated display case, the improvement of claim 10 wherein said second fan is mounted outside the air passage in close proximity to the discharge grille.

12. In a low-bed refrigerated display case, the improvement of claim 11 wherein said means additionally includes a discharge sill disposed adjacent the discharge grille and providing a mounting location for the second fan.

* * * * *

UNITED STATES PATENT AND TRADEMARK OFFICE

CERTIFICATE OF CORRECTION

PATENT NO. : 4,320,631

DATED : March 23, 1982

INVENTOR(S) : John H. Vana

It is certified that error appears in the above-identified patent and that said Letters Patent are hereby corrected as shown below:

Column 1, line 43, change "refrigerted" to --refrigerated--

Column 1, line 46, change "data" to --date--

Signed and Sealed this

*Tenth* Day of *August 1982*

[SEAL]

*Attest:*

GERALD J. MOSSINGHOFF

*Attesting Officer*

*Commissioner of Patents and Trademarks*